United States Patent [19]

Young et al.

[11] 4,164,719

[45] Aug. 14, 1979

[54] LOAD MANAGEMENT APPARATUS FOR RESIDENTIAL LOAD CENTERS

[75] Inventors: John Young, Lawrenceville; Jack Clavell, Lilburn, both of Ga.; George Gaskill, Hatboro, Pa.

[73] Assignee: Gould Inc., Rolling Meadows, Ill.

[21] Appl. No.: 893,208

[22] Filed: Apr. 3, 1978

[51] Int. Cl.[2] ..... H01H 75/00; H01H 77/00

[52] U.S. Cl. ..... 335/14; 335/20

[58] Field of Search ..... 335/14, 20, 8, 9, 10; 307/38, 39, 40; 219/327

[56] References Cited

U.S. PATENT DOCUMENTS

| | | | |
|---|---|---|---|
| 3,369,202 | 2/1968 | Gryctko | 335/20 |
| 3,906,413 | 9/1975 | Clausing | 335/14 |

*Primary Examiner*—Harold Broome

*Attorney, Agent, or Firm*—Ostrolenk, Faber, Gerb & Soffen

[57] ABSTRACT

Load management apparatus constituting a direct replacement for a conventional molded case circuit breaker consists of half-inch wide switching and management modules connected in series between an electrical load and its energizing source. The switching module is a conventional circuit breaker and the management module includes a normally closed electromagnetic contactor provided with a permanent magnet latch which holds the contactor in open position. Remotely generated signals are utilized to selectively energize the main operating coil which opens the contactor and to selectively energizing the bucking coil which releases the magnetic latch.

10 Claims, 6 Drawing Figures

LOAD MANAGEMENT APPARATUS FOR RESIDENTIAL LOAD CENTERS

Notwithstanding sharply rising costs for producing electrical energy the demand for electricity continues to increase. This demand often exceeds existing capacity. On occasion, excessive demand has caused generating system breakdowns resulting in complete de-energization of large blocks of consumers. In other instances, excess demand has been handled by reducing voltage. This is unsatisfactory to consumers having equipment which functions poorly or ceases to function in the absence of full voltage availability.

In order to obviate the necessity for expanding the capacity for generating electrical energy to meet peak demands of relatively short duration, it has been proposed that the power generating companies be provided with the capability of load management independently of control by the customers. That is, equipment is provided which enables the power company to de-energize selected loads of certain customers without interrupting electrical service to more critical loads. Typically, the load that is interrupted during high demand periods is a non-critical home appliance such as an electric water heater or an air conditioner.

The prior art has suggested the foregoing type of load management by utilizing a switch connected in series with the circuit breaker through which the appliance in question is energized. This switch is operated electrically to open circuit position by a control signal which the utility generates at a location remote from the contactor.

According to the instant invention, load management apparatus in the form of a series connected switch-circuit breaker arrangement is constructed for convenient mounting in the same panelboard having the load circuit breaker which formerly controlled energization of the appliance in question. The circuit breaker is manually operated by the consumer and is provided with automatic trip means which opens the circuit breaker contacts under fault conditions. The switch is a normally closed electromagnetic contactor which is provided with a hold open latch. Standby power is not required to maintain the contactor in either open or closed position in that the contactor is biased closed and the hold-open latch is either mechanical or of the permanent magnet type. Control signals generated selectively by the utility company at a location remote from the customer are used to release the latch and to open contactor.

Accordingly, the primary object of the instant invention is to provide a novel apparatus for management of electrical loads from a location remote from the load.

Another object is to provide novel load management apparatus which is readily mountable in conventional panelboards at locations designated for conventional circuit breakers.

Still another object is to provide load management apparatus of this type which includes a normally closed electromagnetic contactor connected as a remotely controlled switch.

A further object is to provide load management apparatus of this type in which a remotely controlled latch is used to hold the contacts of the contactor open.

These objects as well as other objects of this invention shall become readily apparent after reading the following description of the accompany drawings in which:

FIG. 1 is a plan view of load management apparatus constructed in accordance with teachings of the instant invention.

FIGS. 2 and 3 are end views of the load management apparatus looking in the directions of the respective arrows 2—2 and 3—3 of FIG. 1.

Figure 1:
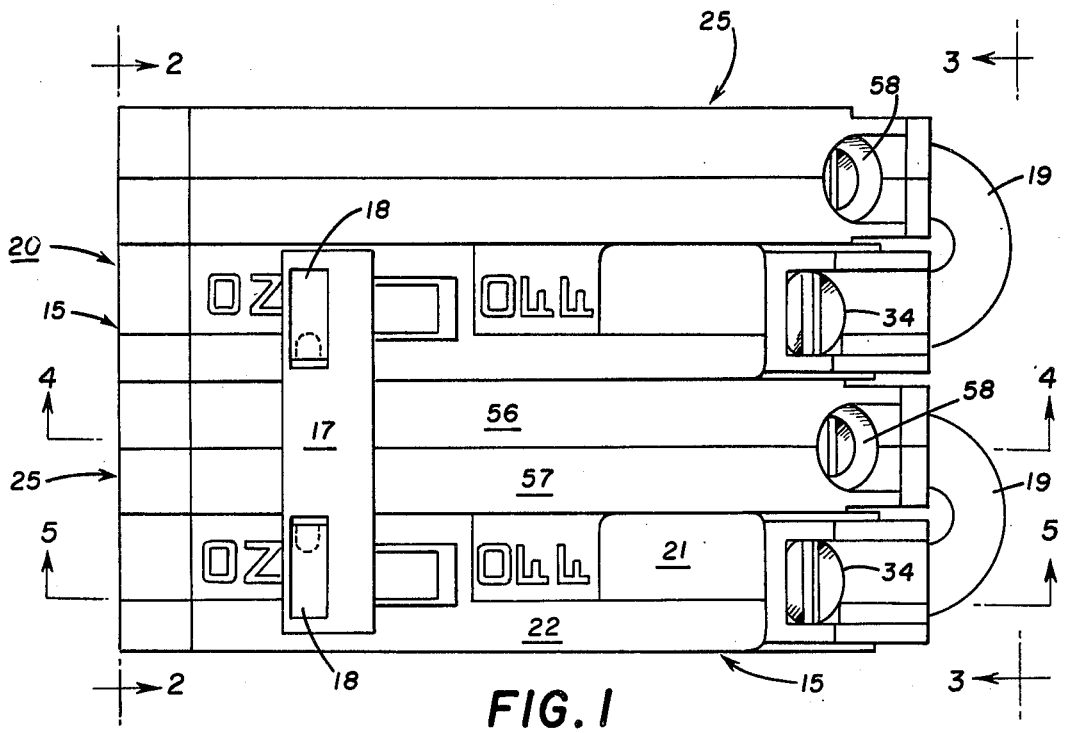

Now referring to the Figures. Load management apparatus 20 is illustrated in FIG. 1 as a two-pole unit. Each pole of apparatus 20 is of identical construction and consists of a manually operable switching section 15 connected in electrical series with a remotely operable management section 25 by a single conductor 19. The switching section handles 18, 18 are mechanically tied together by cap member 17 which extends in front of the management section 25 disposed between the switching sections 15, 15. As seen best in FIGS. 1, 2 and 3, each of the sections 15 and 25 is of substantially the same width and each constitutes a module. In practical embodiments each module is between one half and one inch wide. All of the modules 15 and 25 are stacked side by side and have profiles (side elevations) having similar though not necessarily identical outlines.

Switching module 15 is a conventional single pole molded case circuit breaker having a narrow housing consisting of base 21 and cover 22 which cooperate to enclose and position the operating elements. The current path through switching module 15 extends from line terminal member 26, stationary contact 27, movable contact 28, movable contact arm 29, flexible conductor 31, bimetal 32 and deformable load terminal strap 33 which terminates in wire grip 34. Manual operating handle 17 is at the forward end of operating member 36 which is mounted on pivot 37. The upper end 38 of movable contact arm 29 is pivotally supported at the lower end of operating member 36, being biased thereagainst by main operating spring 39. The latter is a coiled tension member having its lower end 41 connected to contact arm 29 and its upper end 42 connected to releasable cradle 44 at notch 43 in the forward edge thereof at a point intermediate cradle pivot 46 and latching tip 47.

Figure 5:
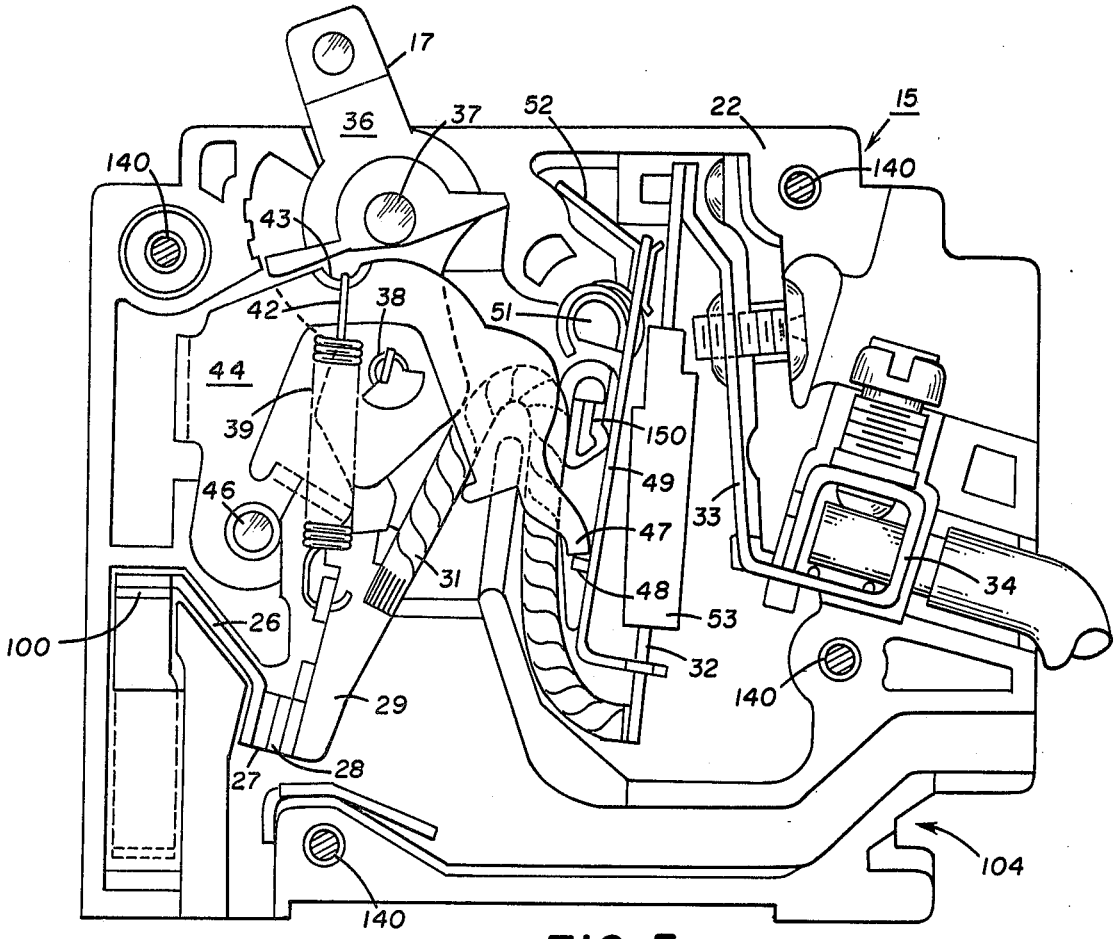
FIG. 5 is a side elevation of the switching module looking in the direction of arrows 5—5 of FIG. 1 with the near housing section removed to reveal the internal elements of the module.

When tip 47 is supported by latch extension 48 of latch member 49, the contact operating mechanism is in its reset position shown in FIG. 5. The upper end of latch member 49 is mounted to pivot formation 51 and the lower end of member 49 is offset and provided with a notch through which the lower end of bimetal 32 extends. Wire spring 52 engages the forward end of member 49 biasing the latter toward the latching position shown in FIG. 5. Member 49 constitutes a magnetic armature which is attracted to U-shaped yoke 53 under predetermined overload current conditions. Bimetal 32 extends between the arms of yoke 53 to provide a single energizing turn. As bimetal 32 heats the rear or lower end thereof moves to the right with respect to FIG. 5 causing latch member 49 to pivot counterclockwise so that latch support 48 releases cradle 44. This repositions the line of action of spring 39 so that the latter pivots movable contact arm 29 counterclockwise thereby separating movable contact 28 from stationary contact 27.

Figure 4:
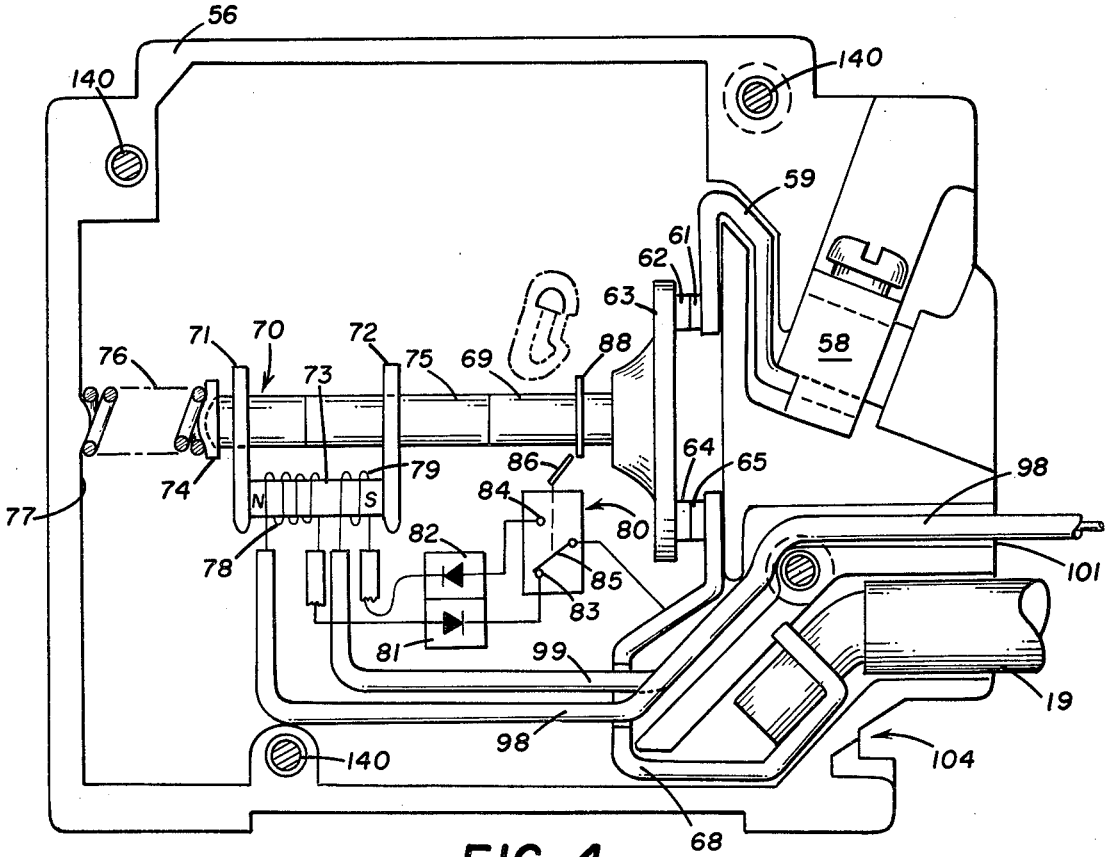
FIG. 4 is a side elevation of the management module looking in the direction of arrows 4—4 of FIG. 1 with the near housing section removed to reveal the internal elements of the module.

Management module 25 includes a molded insulated housing consisting of base 56 and cover 57. As seen in FIG. 4, the main current path through module 25 consists of wire grip 58, terminal strap 59, stationary contact 61, movable contact 62 at one end of bridge 63, bridge 63, movable contact 64 at the other end of bridge 63, stationary contact 65 and terminal strap 68 having jumper 19 connected thereto.

Bridging contact 63 is mounted to the right end of rod 69 having a circular cross-section. Rod 69 extends through aligned guide apertures in spaced magnetic frame members 71, 72 of solenoid 70 and the curved left end of rod 69 extends into a central depression in spring guide 74. The latter is engaged by the right end of coiled compression spring 76 whose left end bears against internal wall 77 of housing part 56. Thus, spring 76 biases bridging contact 63 toward the closed circuit position shown in FIG. 4.

The magnetic frame of solenoid 70 also includes a permanent magnet in the form of bar 73 whose opposite ends are engaged by magnetic frame members 71, 72, respectively. The central portion 75 of rod 69 is constructed of magnetic material and constitutes the movable armature for solenoid 70. The end portions of rod 69 are constructed of nonmagnetic material. When operating coil 78 of solenoid 70 is energized, armature 75 is attracted toward member 71 thereby moving rod 69 to the left to separate movable contacts 62, 64 from stationary contacts 61, 65 thereby opening the main circuit between jumper 19 and wire grip 58. When armature 75 reaches member 71 the magnetic flux generated by permanent magnet 73 is of sufficient magnitude to hold armature 75 in this position even when operating coil 78 is deenergized. Thus, permanent magnet 73 acts to latch bridge 63 in the open circuit position.

The energizing circuit for coil 78 extends through diode 81 which is so connected that the flux generated by coil 78 aids flux generated by permanent magnet 73. To release armature 75, coil 79 is energized. The energizing circuit for the latter extends through diode 82 which is connected so that the flux generated by coil 79 bucks the flux generated by permanent magnet 73 thereby releasing armature 75 and permitting operating spring 76 to operate bridge 63 to the closed circuit position shown in FIG. 4.

One end of operation coil 78 is connected to control wire 98 which extends externally of housing 56, 57 through aperture 101 at the load end thereof. The other end of coil 78 is connected through diode 81 to stationary contact 83 of delayed action toggle switch 80 having another stationary contact 84 which is connected through diode 82 to one end of release coil 79. The other end of the latter is connected to control wire 99 which extends externally of housing 56, 57 through aperture 101. Switch 80 also includes movable contact 85 connected by lead 87 to strap 68.

Contact 85 is operated by a well known spring mechanism (not shown) having handle extension 86. The latter is a spring member which is pivotally operated through engagement with collar 88 carried by rod 69. A short while after release coil 79 is energized to permit the closing of the main contacts 61–65 of module 25, movable contact 85 moves to the position shown in FIG. 4 wherein the energizing circuit for coil 79 is broken and the energizing circuit for operating coil 78 is made ready for completion. When the energizing signal for operating coil 78 is applied, rod 69 moves to the left with respect to FIG. 4 and collar 88 thereon operates switch member 86 to move contact 85 into engagement with stationary contact 84. This breaks the circuit through contact 83 de-energizing coil 78 and making the energizing circuit for coil 79 ready for the application of a control signal to energize release coil 79. It is noted that there is a small delay between operations of member 86 and movement of movable contact 85. This is to assure that armature 75 is so positioned that permanent magnet latch 73 will be effective when the energizing circuit for operating coil 78 is broken.

Figure 2:
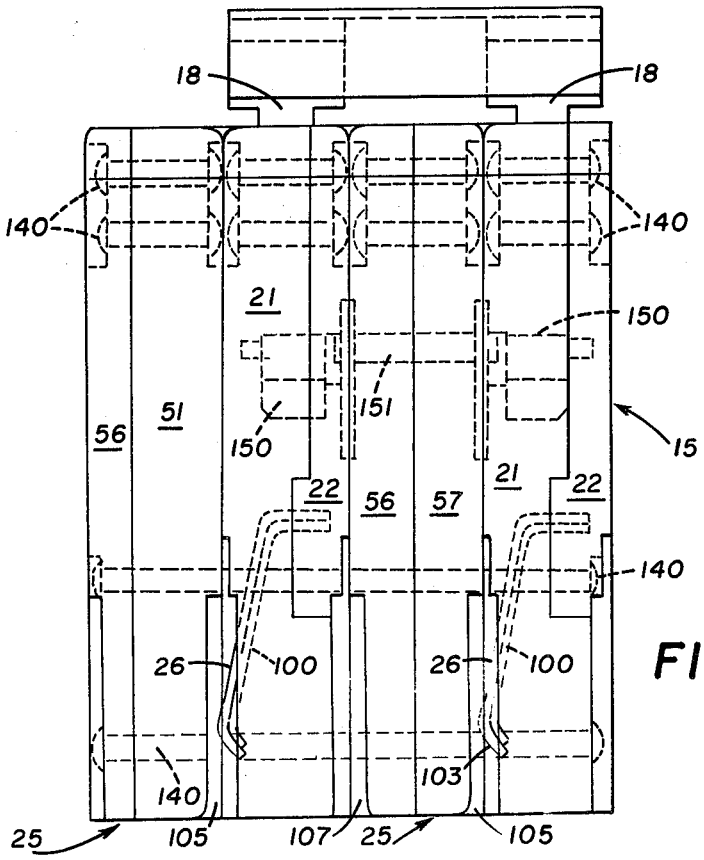
Figure 6:
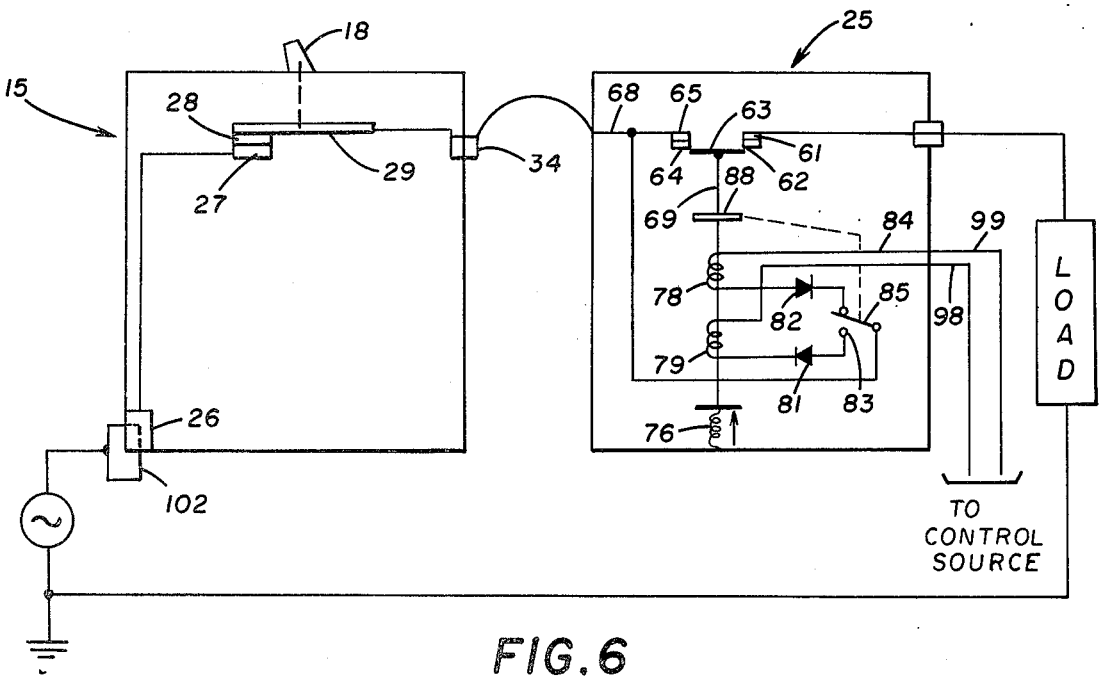
FIG. 6 is a diagram illustrating the electrical connection between a load and a power source through single pole load management apparatus constructed in accordance with teachings of the instant invention.

As seen in FIG. 2, the free end of line terminal 26 remote from stationary contact 27 extends into clearance notch 105 formed by confronting depressions in housing elements 21, 57. When apparatus 20 is plugged into a conventional panelboard having a plurality of plug-in blades 102, one of which is shown schematically in FIG. 6, aligned in a row and spaced on one inch centers, each recess 105 receives a blade 102 which engages member 26. Clearance notch 107 formed by confronting depressions in housing elements 22, 56 also receives a panelboard plug-in blade 102 but no electrical connection is made to the latter. Contact member 26 is constructed of spring material which deflects to provide contact pressure at area 103 on contact 26 where the latter engages the aforesaid plug-in blade. Steel backup spring 100 bears against contact 26 to increase contact pressure at area 103.

Figure 3:
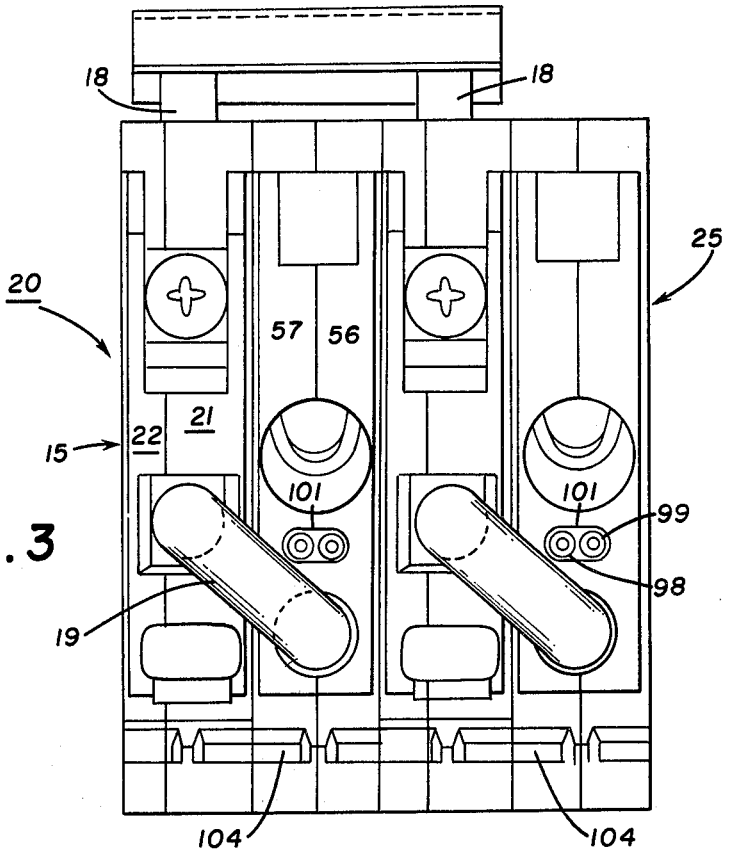

As seen in FIG. 3 the load ends of housing sections 21, 57 are provided with aligned recesses which combine to form notch 104 to receive a mechanical mounting hook (not shown) of a conventional panelboard. Thus, it is seen that load management apparatus 20 is constructed for mounting in a conventional panelboard at locations provided for plug-in circuit breakers. There is no need to provide additional mounting provisions.

It should be apparent to those skilled in the art that some of the transversely extending rivets 140 secure pairs of housing sections 21, 22 and 56, 57 together so that modules 15, 25 may be handled conveniently even though they are manufactured at different locations, and that the remaining transversely extending rivets 140 secure modules 15, 25 together in a unitary structure constituting load management apparatus 20. As seen in FIGS. 2 and 5, module 15 is provided with pivotally mounted trip lever 150 interposed between cradle 44 and latch member 49. In a manner well known to the art, trip levers 150, 150 of both modules 15, 15 are drivingly connected by non-circular insulating rod 151 which extends through aligned apertures in facing sides of modules 15, 15 and in both sides of the module 25 disposed between modules 15, 15.

Even though modules 15 and 25 are shown interleaved, it should be apparent to those skilled in the art that in a two pole arrangement two switching modules 15 may be stacked adjacent to each other with one management module 25 on each side of the switching module stack. As another alternative, two management modules 25 may be stacked adjacent to each other and the switching module stack positioned adjacent one side of the management module stack.

Further, for some applications a single pole arrangement of one module 15 and one module 25 may be utilized. Still further, even though there are two circuit breaker modules 15, one in each load line, it may be sufficient to utilize a load management module 25 in only one load line. In the latter event, the four module stack will include a dummy module.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Load management apparatus including a manually operable switching section and a remotely operable management section; said switching section including interrupter contact means, a manually operable spring powered first mechanism connected to said interrupter contact means for opening and closing thereof, fault responsive trip means operatively connected to said first mechanism to operate the latter for opening of said interrupter contact means upon the occurence of predetermined fault currents at said switching section; said management section including mechanical main contact means connected in series circuit with said interrupter contact means and an electrical load energized through said apparatus, biasing means normally maintaining said main contact means closed, remotely controlled electrically powered operator means operatively connected to said main contact means for selectively operating the latter to open said main contact means; said switching section and said management section constituting first and second modules respectively; said first and second modules including respective first and second housings of substantially equal widths stacked side-by-side.

2. Load management apparatus as set forth in claim 1 in which the housings have similar profiles.

3. Load management apparatus as set forth in claim 1 also including latch means for maintaining said main contact means open after opening thereof by said operator means.

4. Load management apparatus as set forth in claim 3 also including remotely controlled electrically powered release means operatively connected to said latch means for selectively unlatching the latter thereby permitting the biasing means to close said main contact means.

5. Load management apparatus as set forth in claim 1 in which a single conductor extending external of said housing electrically connects said main and said interrupter contact means in series.

6. Load management apparatus as set forth in claim 4 in which a single conductor extending external of said housing electrically connects said main and said interrupter contact means in series.

7. Load management apparatus as set forth in claim 6 in which the housings have similar profiles.

8. Load management apparatus as set forth in claim 1 in which each of the housings are no more than one inch wide.

9. Load management apparatus as set forth in claim 1 also including a contact engageable directly with a line terminal in a conventional panelboard when said apparatus is mounted in the latter at a location constructed for mounting of a conventional circuit breaker.

10. Load management apparatus as set forth in claim 9 in which the line terminal is of a plug-in type held by friction in engagement with a line terminal of a panelboard.

* * * * *

Notice of Adverse Decision in Interference

In Interference No. 100,746, involving Patent No. 4,164,719, J. Young, J. Clavell and G. Gaskill, LOAD MANAGEMENT APPARATUS FOR RESIDENTIAL LOAD CENTERS, final judgment adverse to the patentees was rendered Mar. 7, 1983, as to claims 1–4.

[*Official Gazette May 17, 1983.*]